US009643623B2

(12) United States Patent
McKisic

(10) Patent No.: US 9,643,623 B2
(45) Date of Patent: May 9, 2017

(54) GUSSETS FOR REINFORCEMENT IN TANK CARS AND TANK CARS INCLUDING GUSSETS

(75) Inventor: Aubra D. McKisic, Flower Mound, TX (US)

(73) Assignee: Trinity Industries, Inc., Dallas, TX (US)

( * ) Notice: Subject to any disclaimer, the term of this patent is extended or adjusted under 35 U.S.C. 154(b) by 790 days.

(21) Appl. No.: 13/538,419

(22) Filed: Jun. 29, 2012

(65) Prior Publication Data

US 2014/0000474 A1 Jan. 2, 2014

(51) Int. Cl.
*B61D 5/06* (2006.01)
*B65D 90/00* (2006.01)

(52) U.S. Cl.
CPC ..... *B61D 5/06* (2013.01); *B61D 5/08* (2013.01); *Y10T 403/16* (2015.01)

(58) Field of Classification Search
USPC ..... 105/377.01–377.08; 52/20; 248/519
See application file for complete search history.

(56) References Cited

U.S. PATENT DOCUMENTS

| | | | | |
|---|---|---|---|---|
| 1,671,138 | A | 3/1925 | Tiley | |
| 1,800,396 | A * | 4/1931 | Mohun | 105/377.07 |
| RE19,537 | E * | 4/1935 | Pierce | 220/562 |
| 5,467,719 | A * | 11/1995 | Dalrymple et al. | 105/362 |
| 5,723,192 | A * | 3/1998 | Jonasz | 428/64.1 |
| 6,053,113 | A * | 4/2000 | Shaddle | 105/377.07 |
| 6,216,603 | B1 * | 4/2001 | Shaddle | 105/377.07 |
| 6,953,302 | B1 * | 10/2005 | Kochling | 404/26 |
| 7,648,308 | B2 * | 1/2010 | Cuny et al. | 404/26 |
| 7,849,801 | B2 * | 12/2010 | Dalrymple et al. | 105/358 |
| 7,896,307 | B2 * | 3/2011 | Berg | 248/519 |
| 7,975,622 | B2 * | 7/2011 | Dalrymple et al. | 105/358 |
| 2003/0145527 | A1 * | 8/2003 | Meyers | 52/20 |
| 2006/0185554 | A1 * | 8/2006 | Dalrymple et al. | 105/358 |
| 2007/0125259 | A1 * | 6/2007 | Dalrymple | 105/236 |

(Continued)

FOREIGN PATENT DOCUMENTS

| | | | |
|---|---|---|---|
| GB | 221007 | 1/1924 | B61D 5/06 |

OTHER PUBLICATIONS

"Specifications for Tank Cars," AAR Manual of Standards and Recommended Practices, Oct. 2007, pp. 56, 228.

(Continued)

*Primary Examiner* — Jason C Smith
(74) *Attorney, Agent, or Firm* — Baker Botts, LLP

(57) ABSTRACT

A gusset is capable of providing reinforcement in tank cars, particularly for nozzles in tank cars. A tank car includes a body having a curved wall portion, a nozzle opening formed in the wall, a reinforcing pad disposed on the wall, adjacent to the nozzle, and a gusset configured to support the nozzle. The gusset includes a portion of a cylinder having a predetermined radius. The portion of the cylinder includes a first edge disposed adjacent to a circumferential surface of the nozzle and a second edge disposed adjacent to a circumferential surface of the reinforcing pad, such that an axis of the portion of the cylinder intersects an axis of the nozzle at a predetermined angle. The predetermined radius and the predetermined angle are configured such that an arc of the portion of the cylinder extends less than approximately 180 degrees.

22 Claims, 7 Drawing Sheets

(56) References Cited

U.S. PATENT DOCUMENTS

| | | | | |
|---|---|---|---|---|
| 2007/0227077 | A1* | 10/2007 | Cuny et al. | 52/20 |
| 2009/0241799 | A1 | 10/2009 | Saxton et al. | |
| 2010/0319571 | A1 | 12/2010 | Dalrymple et al. | |

OTHER PUBLICATIONS

U.S. Department of Transportation—Federal Railroad Administration, "Survivability of Railroad Tank Car Top Fittings in Rollover Scenario Derailments," DOT/FRA/ORD-06-11, Dec. 14, 2005.
International Search Report and Written Opinion; PCT/US2013/048215; pp. 12, Sep. 19, 2013.
PCT Notification Concerning Transmittal of Copy of International Preliminary Report on Patentability (Chapter I of the Patent Cooperation Treaty) for International Application No. PCT/US2013/048215—Jan. 8, 2015.

* cited by examiner

GUSSETS FOR REINFORCEMENT IN TANK CARS AND TANK CARS INCLUDING GUSSETS

BACKGROUND OF THE INVENTION

1. Field of the Invention

The invention relates generally to supports or gussets for tank car nozzles and tank cars including such gussets for reinforcing nozzles.

2. Description of Related Art

Tank cars have been used for many years to transport a wide variety of commodities. The contents of a tank car sometimes may be potentially hazardous if appropriate safety precautions are not taken. Also, the contents of a tank car may be valuable and subject to theft or misappropriation.

Tank cars are designed with an access opening, manway, nozzle, or the like located in the upper portion of the associated tank, proximate a midpoint between opposite ends of the tank car. A cover plate is typically bolted or otherwise secured to the opening at the top of the nozzle to function as a liquid-tight closure and to allow only limited access to the interior of the tank. Various pipes, valves, fittings and other components are also often located in the vicinity of the opening to control adding and discharging of commodities from the tank car.

In the event of a rollover or accidental horizontal load, the forces acting on the tank car may be sufficient to cause the nozzle or cover plate to be damaged, allowing the contents of the tank car to leak out to the ambient environment, which may cause a hazardous condition and/or unrecoverable loss of the contents of the tank car. Accordingly, tank cars require protective structures for top fittings or nozzles to increase the forces that they can withstand. Nevertheless, tank car reinforcement structures are often difficult to manufacture and apply, are expensive, add significant weight to the tank cars, and may create a tripping hazard.

SUMMARY OF THE INVENTION

Therefore, a need has arisen for supports for tank car nozzles and tank cars including such supports that overcome these and other shortcomings of the related art.

A gusset is configured such that it is capable of providing sufficient reinforcement in tank cars, particularly for nozzles in tank cars. In an embodiment of the invention, a tank car includes a body having a curved wall portion, a nozzle opening formed in the wall, and a gusset configured to support the nozzle. The nozzle includes a substantially cylindrical portion projecting from the wall. The gusset includes a portion of a cylinder having a predetermined radius. The portion of the cylinder includes a first edge disposed adjacent to a circumferential surface of the nozzle and a second edge disposed adjacent to a circumferential surface of the wall, such that an axis of the portion of the cylinder intersects an axis of the nozzle at a predetermined angle. The predetermined radius and the predetermined angle are configured such that an arc of the portion of the cylinder extends less than approximately 180 degrees.

Other objects, features, and advantages of the present invention are apparent to persons of ordinary skill in the art in view of the following detailed description of the invention and the accompanying drawings.

BRIEF DESCRIPTION OF THE DRAWINGS

For a more complete understanding of the embodiments of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Embodiments of the present invention and their features and advantages may be understood by referring to FIGS. 1-14; like numerals being used for corresponding parts in the various drawings.

Figure 1:
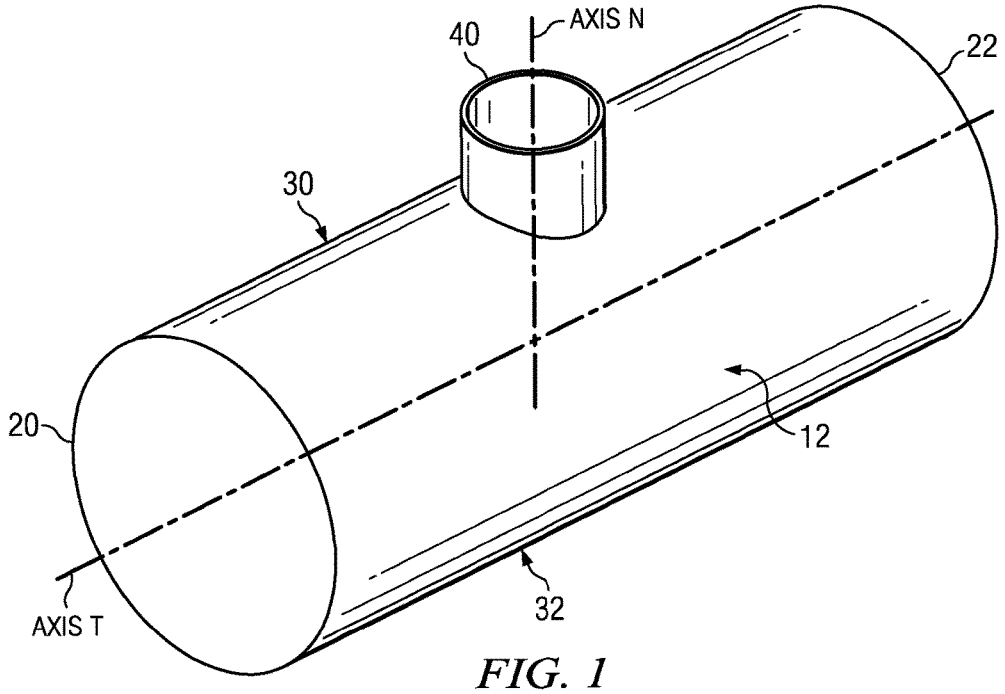
FIG. 1 is an isometric view of a tank car body including a nozzle, according to an embodiment of the invention.
Figure 2A:
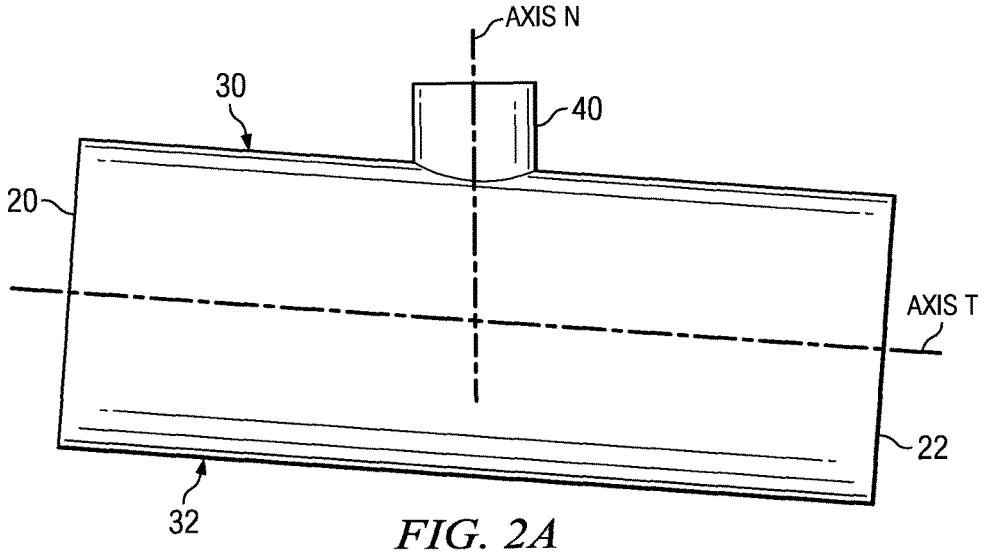
FIG. 2 is a side view of a tank car body including a nozzle, according to an embodiment of the invention.

Referring to FIGS. 1 and 2A, a tank car may include a shell or body 12. Body 12 may comprise a generally elongated hollow cylinder enclosed at a first end 20 and at a second end 22. Body 12 also may include an upper portion 30 and a lower portion 32. The longitudinal axis of body 12 is labeled T.

Figure 14:
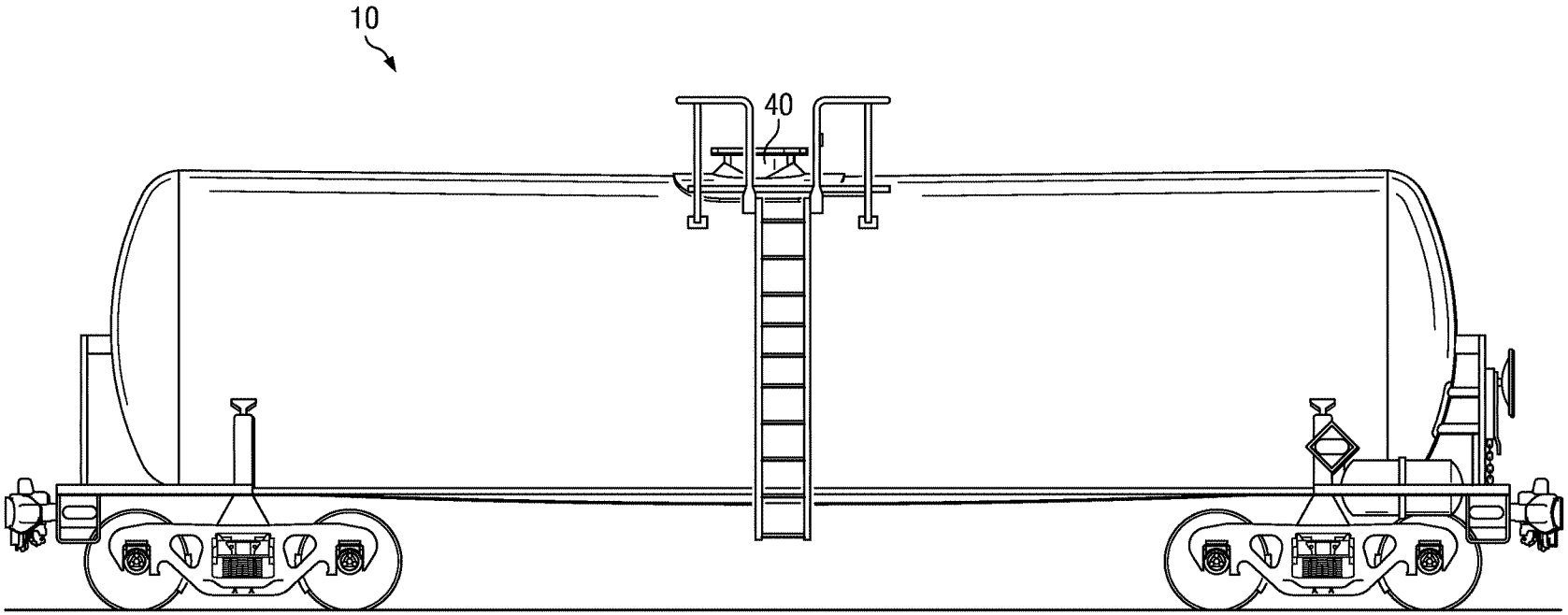
FIG. 14 is a side view of a tank car, according to an embodiment of the invention.

A tank car 10, as depicted in FIG. 14, may be used to transport a variety of hazardous and non-hazardous commodities. The Association of American Railroads Manual of Standards and Recommended Practices, Specifications for Tank Cars ("the Manual") provides industry standards that tank cars are required to meet in providing protective structures for top fittings or nozzles to increase the forces that they can withstand (e.g., Section 2.6 in Chapter 2 and Section 10.2.1 in Appendix E of the Manual). The commodities may be loaded and/or unloaded into the tank through a variety of tank fittings and/or openings, such as a nozzle 40. In an embodiment, nozzle 40 may be disposed proximate a midpoint between opposite ends 20 and 22 of body 12, as depicted in FIG. 1. In other embodiments, nozzle 40 may be located virtually anywhere on body 12, along upper portion 28 of body 12. Further, the shape and/or configuration of tank car 10 may assist in unloading the commodities held therein. For example, as depicted in FIG. 2A, body 12 may slope gradually at lower portion 32 from first end 20 towards second end 22. The configuration and slope of upper portion 30 of body 12 may conform to the configuration and slope of lower portion 32.

Figure 2B:
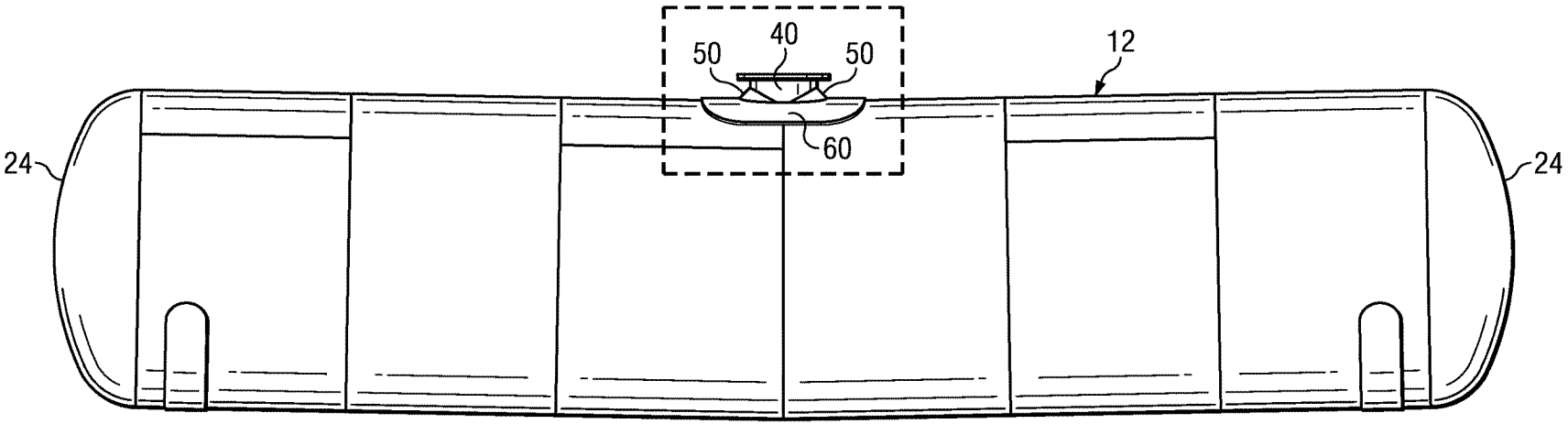

As depicted in FIG. 2B, tank car 10 may further comprise two heads 24, one at first end 20 and one at second end 22, that enclose the cylindrical body. Nozzle 40 may be substantially cylindrically shaped. In other embodiments, nozzle 40 may have a cross-section of different polygonal shapes, curved shapes, polygonal shapes with curved edges (e.g., substantially flat side portions or angled side portions meeting curved side portions), or combinations thereof. The axis of nozzle 40, labeled N in FIGS. 1 and 2A, may extend vertically, parallel to the direction of Earth's gravity.

Figure 3:
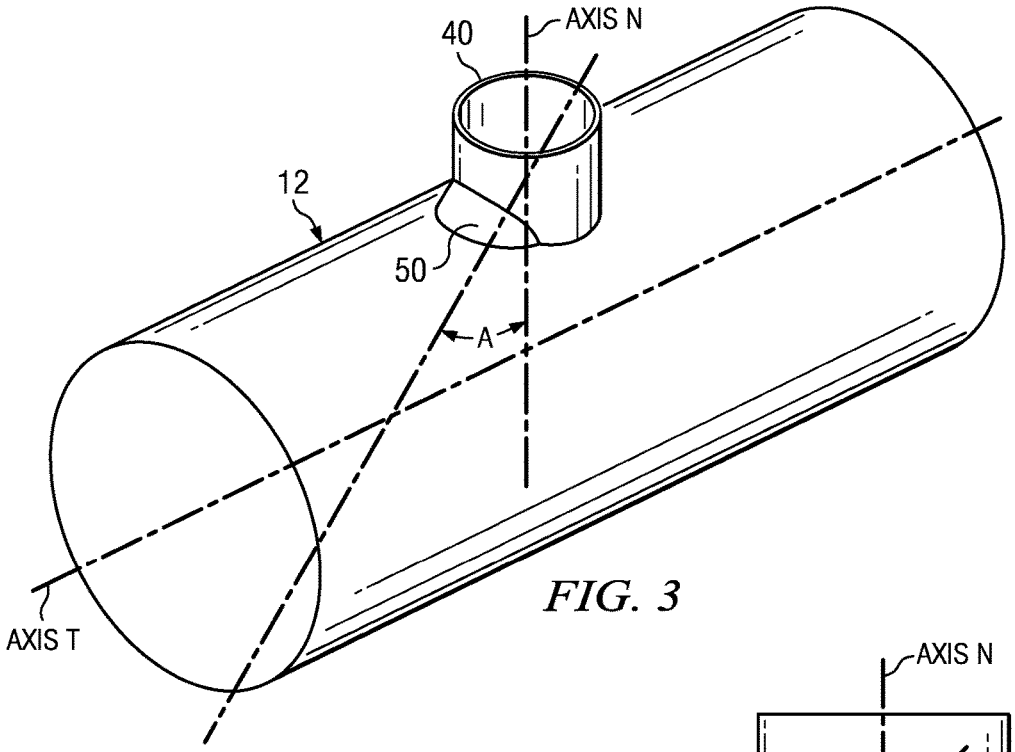
FIG. 3 is an isometric view of a tank car body including a nozzle and a gusset, according to an embodiment of the invention.

FIG. 3 depicts a cylindrical body 12, a cylindrical nozzle 40, and a gusset 50. Gusset 50 may comprise a portion of a cylinder. The shape of the portion of the cylinder that comprises gusset 50 may be based on the size and shape of nozzle 40 and the size and shape of body 12. Thus, an edge of gusset 50 may be shaped to correspond to the size and shape of cylinder 40 and another edge of gusset 50 may be shaped to correspond to the size shape of body 12. In this manner, gusset 50 may be disposed between nozzle 40 and body 12, such that gusset 50 provides sufficient reinforcement for nozzle 40. For example, with such reinforcement, the protective structure of tank car 10 may prevent overstressing of body 12 and nozzle 40 when subjected to forces of ½ W in the vertical downward direction, 1 W horizontal in the longitudinal direction, and ½ W horizontal in the lateral direction, where W is defined as the designed gross rail load of the car, less trucks. A plurality of gussets 50 may be disposed between nozzle 40 and body 12.

Figure 4:
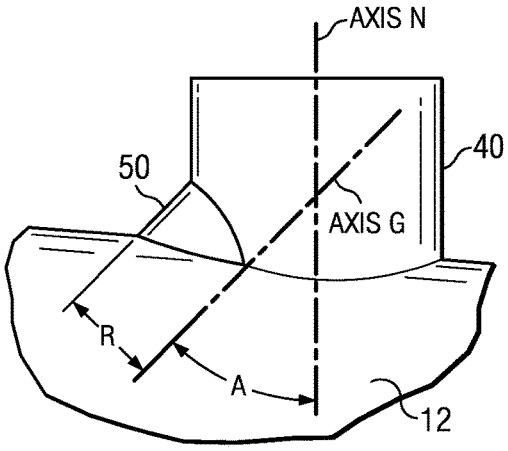
FIG. 4 is a side view of a section of the tank car body including the nozzle and the gusset depicted in FIG. 3.

As depicted in FIGS. 3 and 4, gusset 50 may be disposed such that the axis of the cylinder, of which gusset 50 comprises a portion (hereinafter referred to as the "axis of gusset 50"), which is labeled G, intersects the axis of nozzle 40, which is labeled N. The axis of gusset 50 may intersect the axis of the nozzle at a predetermined angle, A. Angle A may be greater than or equal to 15 degrees and less than or equal to 75 degrees. In an embodiment of the invention, angle A may be approximately 45 degrees. In another embodiment of the invention, angle A may be approximately 60 degrees.

Further, the cylinder, of which gusset 50 comprises a portion, has a predetermined radius, R, as depicted in FIG. 4. In other words, radius R may be the distance from the outermost point along the circumference of gusset 50 to the axis of gusset 50. In a non-limiting example, radius R may be approximately 14 inches. Radius R may be predetermined based on at least the size and configuration of nozzle 40, the size and configuration of body 12, the angle A, or any combination thereof.

Figure 12:
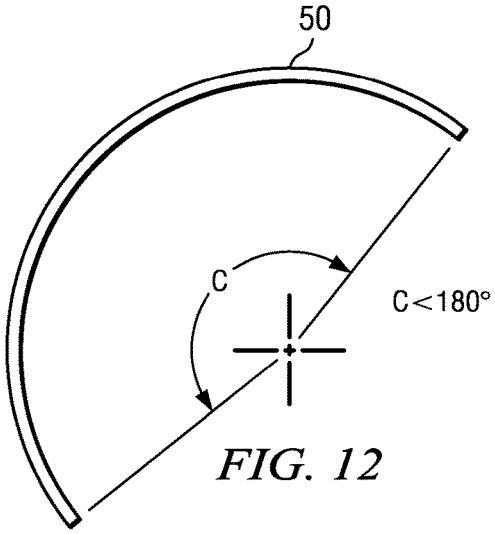
FIG. 12 is a top view of a gusset, according to an embodiment of the invention.

Each of angle A and radius R may be predetermined, such that the arc, C, of gusset 50 extends less than 180 degrees, as depicted in FIG. 12. Thus, when disposed between nozzle 40 and body 12, gusset 50 may extend less than 180 degrees around the circumference of nozzle 40.

Figure 5:
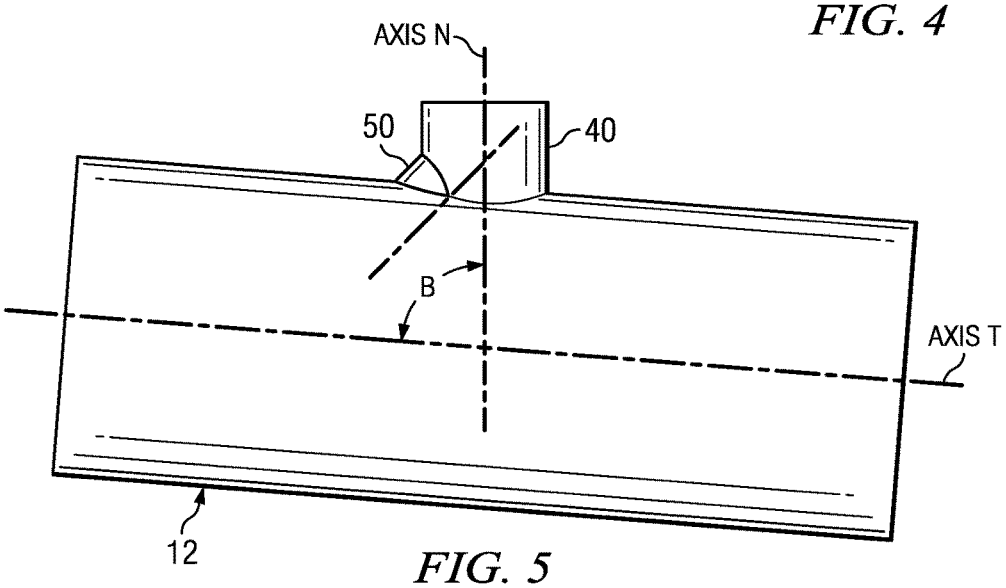
FIG. 5 is a side view of a tank car body including a nozzle and a gusset, according to an embodiment of the invention.

As depicted in FIG. 5, body 12 may include a longitudinal axis, which is labeled T. In an embodiment, longitudinal axis T may extend substantially perpendicularly to the axis of nozzle 40. In another embodiment, body 12 may be sloped by a predetermined amount with respect to the horizontal axis, such that longitudinal axis T is also sloped by the predetermined amount with respect to the horizontal axis. Thus, the axis of nozzle 40 may intersect longitudinal axis T of body 12 at a predetermined angle, B, based on the slope of body 12 and longitudinal axis T. For example, longitudinal axis T of body 12 may slope at less than or equal to approximately 0.5 inch per foot (i.e., less than or equal to approximately 2.386 degrees).

Figure 6:
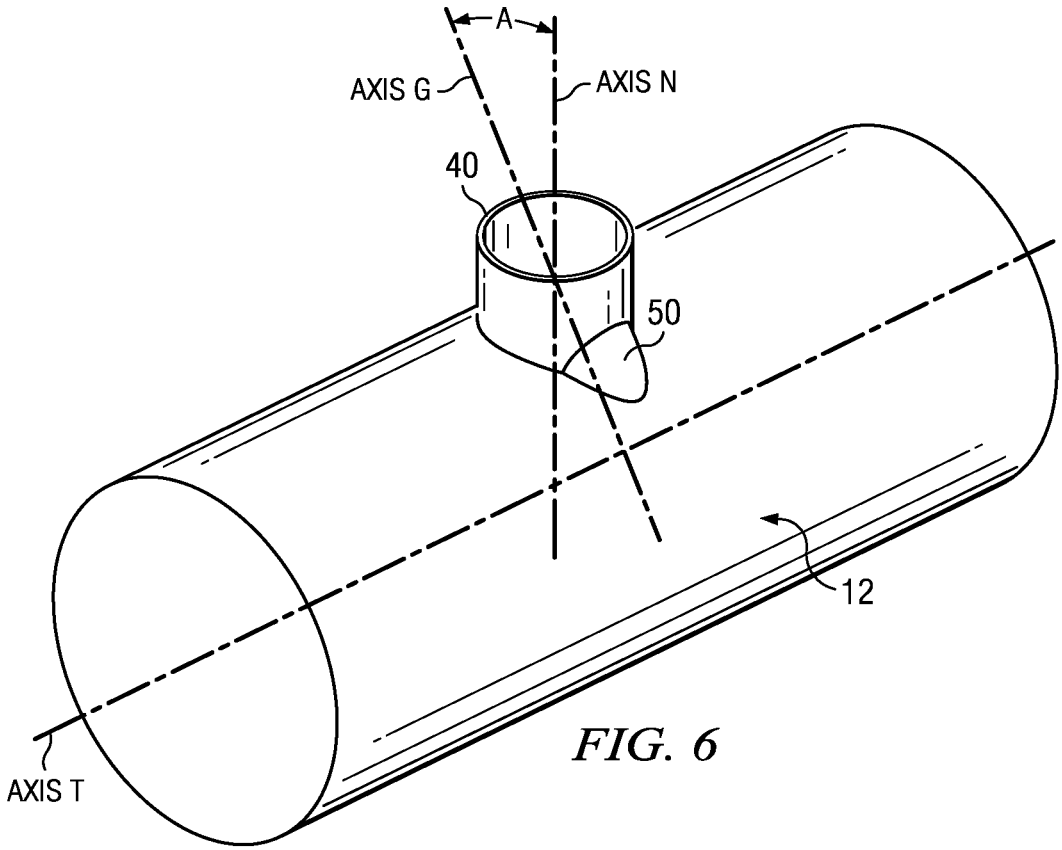
FIG. 6 is a plan view of a tank car body including a nozzle and a gusset, according to another embodiment of the invention.
Figure 7A:
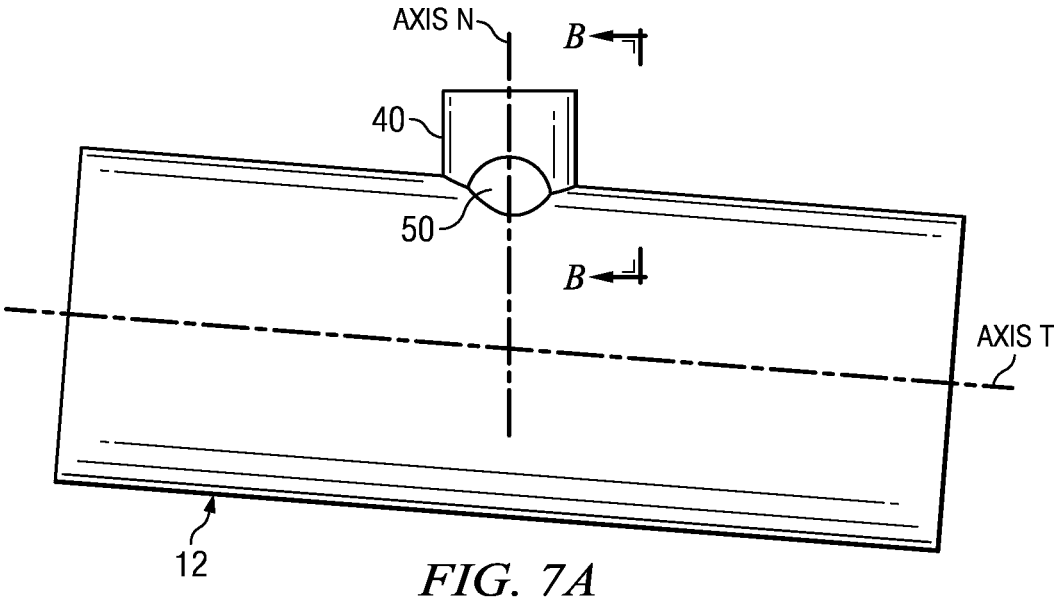
FIG. 7A is a side view of a tank car body including a nozzle and a gusset, according to another embodiment of the invention.

As depicted in FIGS. 3 and 6, gusset 50 may be disposed relative to nozzle 40, such that the axis of gusset 50 and the axis of nozzle 40 are coplanar. Further, as depicted in FIGS. 3 and 6, the axis of nozzle 40 may be coplanar with the longitudinal axis of body 12. In an embodiment, gusset 50 may be disposed, such that the axis of gusset 50, the axis of nozzle 40, and the longitudinal axis of body 12 are coplanar. In other words, a plane comprising axis G and axis N may be the same plane as a plane comprising axis N and axis T, as depicted in FIG. 3. In another embodiment, as depicted in FIG. 6, gusset 50 may be disposed, such that a first plane comprising the axis of gusset 50 and the axis of nozzle 40 is substantially perpendicular to a second plane comprising the axis of nozzle 40 and the longitudinal axis of body 12. In other words, a plane comprising axis G and axis N may be substantially perpendicular to a plane comprising axis N and axis T, as depicted in FIG. 6. FIG. 7A depicts a side view of body 12, nozzle 40, and gusset 50, according to the another embodiment. In other embodiments, gusset 50 may be disposed, such that a plane comprising the axis of gusset 50 and the axis of nozzle 40 intersects a plane comprising the axis of nozzle 40 and the longitudinal axis of body 12 at a non-perpendicular angle.

Figure 7B:
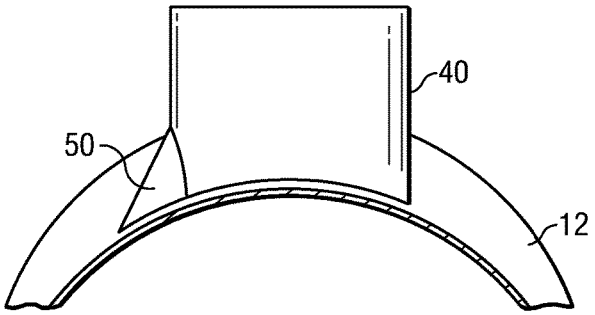
FIG. 7B is a cross-sectional view of the tank car body including a nozzle and a gusset, taken along Line B-B of FIG. 7A.
Figure 8:
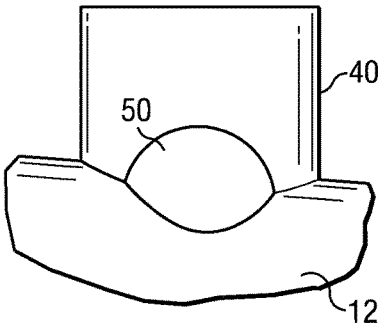
FIG. 8 is a side view of a section of the tank car body including the nozzle and the gusset depicted in FIG. 6.

FIG. 7B depicts a cross-sectional view of body 12 including nozzle 40 and gusset 50, taken along Line B-B of FIG. 7A. Gusset 50 may be disposed between body 12 and nozzle 40, such that an edge of gusset 50 is disposed adjacent to nozzle 40 and another edge of gusset 50 is disposed adjacent to body 12. Further, based on the shape of gusset 50, an interior space may be defined by gusset 50, body 12, and nozzle 40. In other words, gusset 50 may be disposed relative to nozzle 40 and body 12, such that a space exists between gusset 50, nozzle 40, and body 12. FIG. 8 depicts a side view of a section of body 12 including nozzle 40 and gusset 50 disposed as depicted in FIG. 6.

Figure 9A:
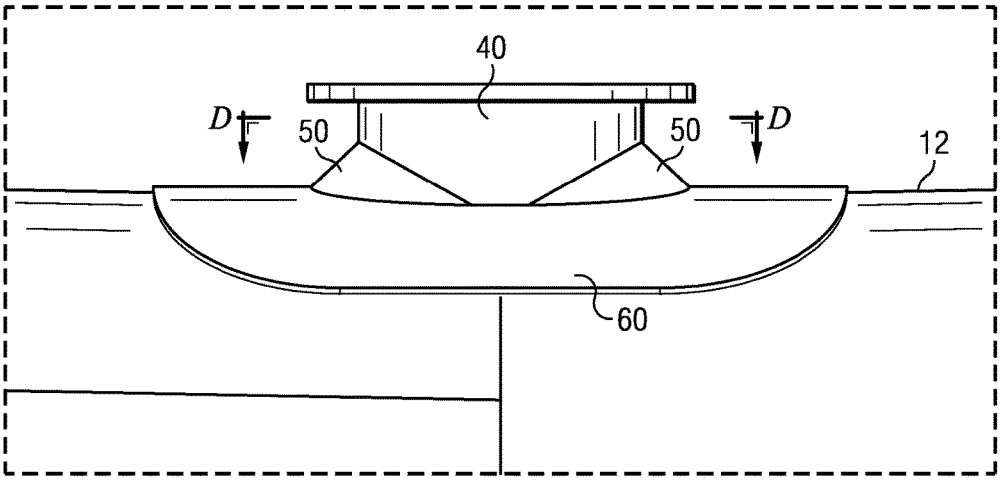
FIG. 9A is a side view of a section of a tank car body including a nozzle, a gusset, and a reinforcing pad, according to a further embodiment of the invention.
Figure 9B:
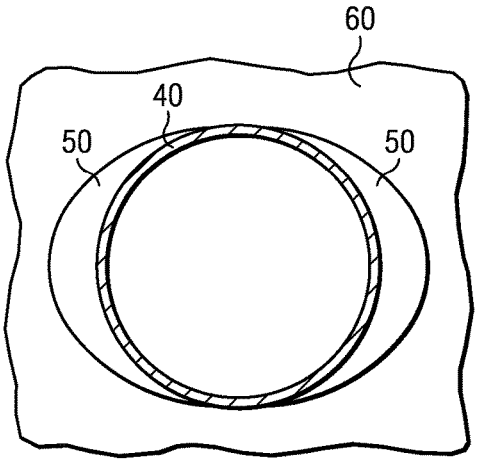
FIG. 9B is a cross-sectional view of the nozzle, the gusset, and the reinforcing pad, taken along Line D-D of FIG. 9A.
Figure 10:
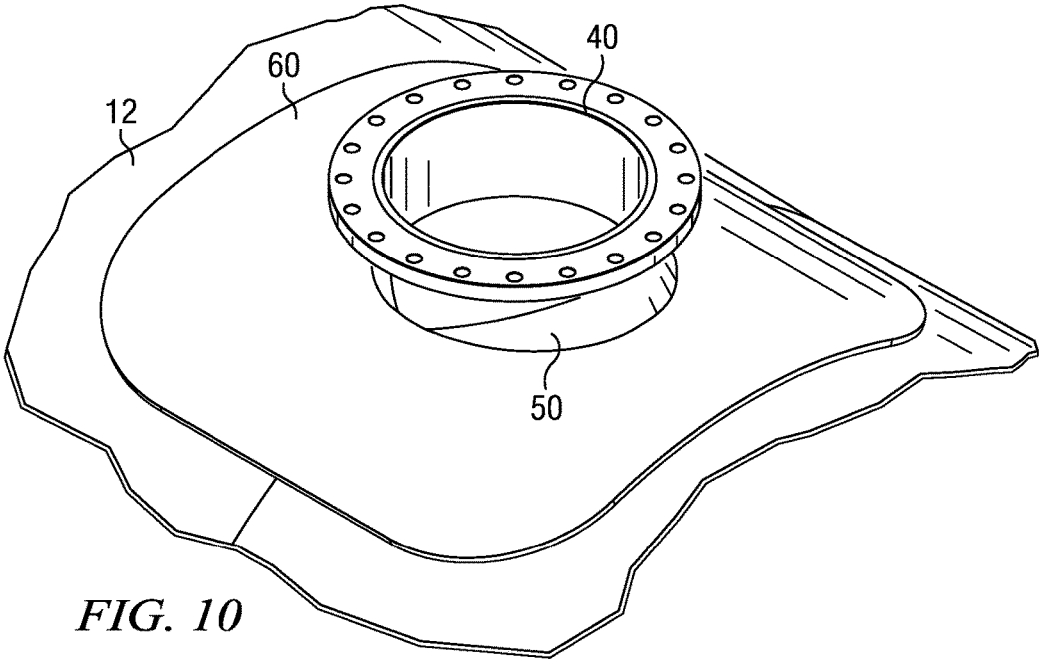
FIG. 10 is a plan view of a section of a tank car body including a nozzle, a gusset, and a reinforcing pad, according to a further embodiment of the invention.

In a further embodiment, a reinforcing pad 60 may be disposed adjacent to, and surrounding, nozzle 40 on tank 12, as depicted in FIGS. 9A, 9B, and 10. Reinforcing pad 60 may be substantially rectangular with an opening formed therethrough in the shape of the horizontal cross-section of nozzle 40. In other embodiments, reinforcing pad 60 may be different polygonal shapes, curved shapes, polygonal shapes with curved edges, or combinations thereof. As depicted in FIG. 9A, gusset 50 may be disposed between reinforcing pad 60 and nozzle 40. One edge of gusset 50 may be coupled to nozzle 40 and another edge of gusset 50 may be coupled to reinforcing pad 60. Gusset 50 may be coupled to nozzle 40 and reinforcing pad 60 via welding, bolt, screw, rivet, adhesive, clamp, solder, or the like, or combinations thereof. Further, based on the shape of gusset 50, an interior space may be defined by gusset 50, reinforcing pad 60, and nozzle 40. In other words, gusset 50 may be disposed relative to nozzle 40 and reinforcing pad 60, such that a space exists between gusset 50, nozzle 40, and reinforcing pad 60.

FIG. 10 depicts a plan view of a portion of body 12, including nozzle 40, reinforcing pad 60 surrounding nozzle 40, and gusset 50 disposed between reinforcing pad 60 and nozzle 40. Reinforcing pad 60 may extend outwardly from nozzle 40 by a predetermined distance. Further, reinforcing pad 60 may have a predetermined thickness and may be coupled to body 12, such that the shape or curvature of reinforcing pad 60 corresponds to the shape or curvature of body 12. FIG. 9B depicts a cross-sectional view of nozzle 40, gusset 50, and reinforcing pad 60, taken along Line D-D of FIG. 9A. As discussed above, the tank car may include a plurality of gussets 50 disposed adjacent to nozzle 40, as depicted in FIG. 9B. Reinforcing pad 60 may have an opening corresponding to nozzle 40, such that reinforcing pad 60 surrounds nozzle 40, with gusset 50 disposed between nozzle 40 and reinforcing pad 60.

Figure 11:
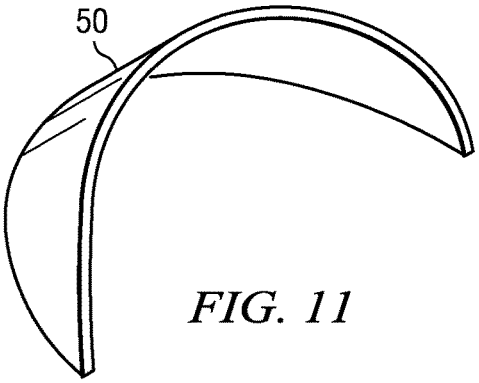
FIG. 11 is a plan view of a gusset, according to an embodiment of the invention.
Figure 13:
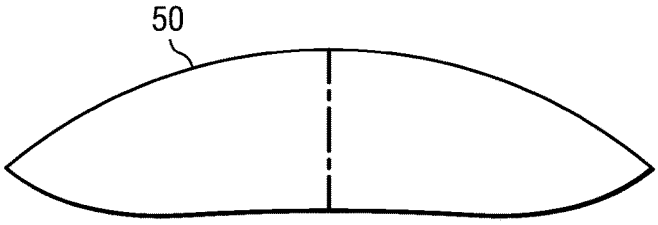
FIG. 13 is a front view of a flat pattern of a gusset, according to an embodiment of the invention.

FIG. 11 depicts a plan view of gusset 50 comprising a portion of a cylinder. The dimensions of the portion of the cylinder may be determined based on the dimensions of nozzle 40, body 12, and reinforcing pad 60, so that gusset 50 fits between nozzle 40 and body 12, or between nozzle 40 and reinforcing pad 60 on body 12. Once the dimensions of the portion of the cylinder are determined, the determined shape may be cut in a flat pattern, as depicted in FIG. 13. The portion of the cylinder may be formed of, for example, structural steels, pressure vessel grade steels, or the like. After the flat pattern is cut, the portion of the cylinder is rolled to a curvature that corresponds to the predetermined radius of the cylinder. The rolled portion of the cylinder may have a predetermined thickness (e.g., greater than or equal to about 7/16 inch or greater than or equal to about 1.11 cm). Thus, gusset 50 may provide a simple and cost-effective manufacturing process.

While the invention has been described in connection with various embodiments, it will be understood by those of ordinary skill in the art that other variations and modifications of the various embodiments described above may be made without departing from the scope of the invention. Other embodiments will be apparent to those of ordinary skill in the art from a consideration of the specification or practice of the embodiments of the invention disclosed herein. The specification and the described examples are considered as exemplary only, with the true scope and spirit of the embodiments of the invention indicated by the following claims.

What is claimed is:

1. A tank car, comprising:

a body comprising a wall;

a nozzle opening formed in the wall, the nozzle comprising a projecting portion extending from the wall;

a reinforcing pad disposed on the wall, adjacent to the nozzle, a gusset configured to support the nozzle, the gusset comprising:

a portion of a cylinder having a predetermined radius, the portion of the cylinder comprising a first edge disposed adjacent to a surface of the nozzle and a second edge disposed adjacent to a surface of the reinforcing pad, such that an axis of the portion of the cylinder intersects an axis of the nozzle at a predetermined angle, wherein the predetermined radius and the predetermined angle are configured such that an arc of the portion of the cylinder extends less than approximately 180 degrees.

2. The tank car of claim 1, wherein the first edge is configured to correspond to the surface of the nozzle and the second edge is configured to correspond to the surface of the reinforcing pad.

3. The tank car of claim 1, wherein the wall comprises a curved portion.

4. The tank car of claim 1, wherein the projecting portion of the nozzle is substantially cylindrical.

5. The tank car of claim 1, wherein the predetermined radius is approximately 14 inches.

6. The tank car of claim 1, wherein the predetermined angle is greater than or equal to approximately 15 degrees and less than or equal to approximately 75 degrees.

7. The tank car of claim 1, wherein the predetermined angle is approximately 45 degrees.

8. The tank car of claim 1, wherein the predetermined angle is approximately 60 degrees.

9. The tank car of claim 1, wherein the axis of the nozzle is coplanar with a longitudinal axis of the body.

10. The tank car of claim 6, wherein the longitudinal axis of the body is sloped with respect to a horizontal axis, and the axis of the nozzle intersects the longitudinal axis of the body at a non-perpendicular angle.

11. The tank car of claim 6, wherein the longitudinal axis of the body extends substantially perpendicularly to the axis of the nozzle.

12. The tank car of claim 1, wherein the second edge of the portion of the cylinder is configured to be coupled to the reinforcing pad.

13. The tank car of claim 1, wherein the axis of the portion of the cylinder, the axis of the nozzle, and a longitudinal axis of the body are coplanar.

14. The tank car of claim 1, wherein a first plane comprising the axis of the portion of the cylinder and the axis of the nozzle is substantially perpendicular to a second plane comprising the axis of the nozzle and a longitudinal axis of the body.

15. The tank car of claim 1, wherein the gusset is cut in a flat pattern with a predetermined shape and rolled into the portion of a cylinder having the predetermined radius.

16. A gusset for a nozzle of a tank car having a reinforcing pad, comprising:

a portion of a cylinder having a predetermined radius, the portion of the cylinder comprising a first edge configured to be coupled to a circumferential surface of the nozzle and a second edge configured to be coupled to a circumferential surface of the reinforcing pad, such that an axis of the portion of the cylinder intersects an axis of the nozzle at a predetermined angle, wherein the predetermined radius and the predetermined angle are configured such that an arc of the portion of the cylinder extends less than approximately 180 degrees.

17. The gusset of claim 16, wherein the first edge is configured to correspond to the surface of the nozzle and the second edge is configured to correspond to the surface of the reinforcing pad.

18. The gusset of claim 16, wherein the predetermined radius is approximately 14 inches.

19. The gusset of claim 16, wherein the predetermined angle is greater than or equal to approximately 15 degrees and less than or equal to approximately 75 degrees.

20. The gusset of claim 16, wherein the predetermined angle is approximately 45 degrees.

21. The gusset of claim 16, wherein the predetermined angle is approximately 60 degrees.

22. The gusset of claim 16, wherein the portion of a cylinder is cut in a flat pattern with a predetermined shape and rolled into the portion of a cylinder having the predetermined radius.

* * * * *